United States Patent [19]

Hokama

[11] Patent Number: 4,554,935

[45] **Date of Patent: * Nov. 26, 1985**

[54] ARTIFICIAL FINGERNAIL WITH HOLES TO RECEIVE LIQUID ADHESIVE

[75] Inventor: Yosh Hokama, Torrance, Calif.

[73] Assignee: International Beauty Distributors, Inc., Gardena, Calif.

[ * ] Notice: The portion of the term of this patent subsequent to Mar. 13, 2001 has been disclaimed.

[21] Appl. No.: 578,511

[22] Filed: Feb. 9, 1984

[51] Int. Cl.[4] ..... A45D 29/00

[52] U.S. Cl. ..... 132/73; 132/88.5

[58] Field of Search ..... 132/73, 88.5, 88.7; 273/82 A

[56] References Cited

U.S. PATENT DOCUMENTS

| | | | |
|---|---|---|---|
| 2,166,950 | 7/1939 | German et al. | 273/82 A |
| 2,864,384 | 12/1958 | Walter | 132/73 |
| 2,941,535 | 6/1960 | Lappe | 132/73 |
| 3,856,026 | 12/1974 | Gaydos | 132/73 |
| 3,982,551 | 9/1976 | Bartolucci | 132/73 |
| 3,993,084 | 11/1976 | Cullen | 132/73 |
| 4,135,526 | 1/1979 | Matranga et al. | 132/73 |
| 4,211,246 | 7/1980 | Hokama | 132/76.4 |
| 4,346,720 | 8/1982 | Hokama | 132/73 |
| 4,408,622 | 10/1983 | Meyerhoefer | 132/73 |

*Primary Examiner*—Gene Mancene
*Assistant Examiner*—Carolyn A. Harrison
*Attorney, Agent, or Firm*—William W. Haefliger

[57] ABSTRACT

An artificial fingernail is attachable to a natural fingernail having a forward edge, the artificial nail comprising:

(a) a thin plastic sheet element sized to provide a forward extension of the natural nail, (b) the said element having a rearward portion with its underside shaped to fit over and attach to the natural nail by means of liquid adhesive, the element rearward portion also having an upper side, (c) that rearward portion having at least one opening between its under and upper sides to receive liquid adhesive when the underside is pressed downwardly upon the natural nail, whereby the liquid adhesive when cured substantially fills the opening or openings and locks the natural nail to the wall or walls of the opening or openings.

7 Claims, 6 Drawing Figures

ARTIFICIAL FINGERNAIL WITH HOLES TO RECEIVE LIQUID ADHESIVE

BACKGROUND OF THE INVENTION

This invention relates generally to artificial fingernails, and more particularly to methods for better locking such nails to natural nails and for better locking nail polish to the artificial nails.

One problem encountered in fastening artificial nails to natural nails results from "squeeze-out" of liquid glue or adhesive from between the two nails and onto the edges of the artificial nail. Air pockets can thus be left between the nails, no adherence thus taking place at such pockets. This increases the incidence of unwanted lift-off of the artificial nail; also, bacteria can collect in the air pockets, with increased risk of infection.

Another problem is that of "peel-off" of nail polish from the smooth upper surfaces of artificial nails, and particularly starting at nail edges.

SUMMARY OF THE INVENTION

Major objects of the invention include elimination of the above described and associated problems and difficulties, by unusually effective and means. Basically, desired nail adherence is achieved by the provision of:

(a) a thin plastic sheet element sized to provide a foreward extension of the natural nail, (b) the said element having a rearward portion with its underside shaped to fit over and attach to the natural nail by means of liquid adhesive, said element rearward portion also having an upper side, (c) said rearward portion having at least one opening between said under and upper sides to receive liquid adhesive when said underside is pressed downwardly upon the natural nail, whereby the liquid adhesive when cured substantially fills the opening or openings and locks the natural nail to the wall or walls of the opening or openings.

Typically, multiple pin hole size openings are provided through the rear portion of the artificial nail element, to receive liquid adhesive at multiple locations for effectively "adhesively riveting" the artificial nail to the natural nail, as will appear. Air pockets and unwanted lift-off are thereby prevented, and a stronger based and longer lasting nail are thereby created.

The problem of polish peel-off is prevented by roughening the top surface of the artificial nail, and specifically grooving that surface to provide groove intersections with the nail edges where peel-off could otherwise start. Polish penetrates and cures in the grooves, and at the nail edges, to substantially increase resistance to peel-off.

These and other objects and advantages of the invention, as well as the details of an illustrative embodiment, will be more fully understood from the following description and drawings, in which:

DRAWING DESCRIPTION

DETAILED DESCRIPTION

Figure 1:
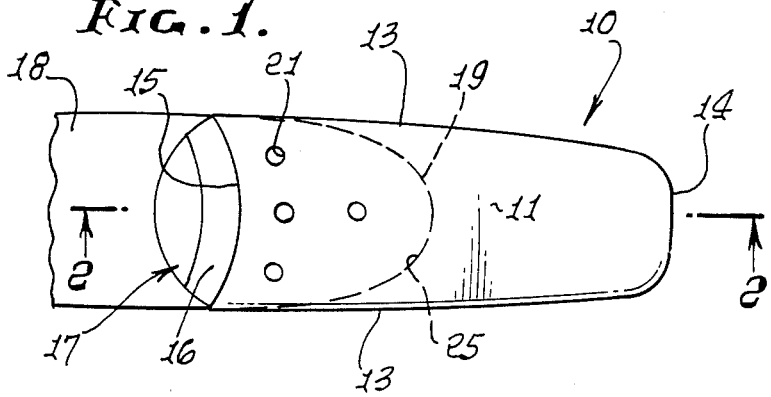
FIG. 1 is a plan view of an artificial fingernail embodying the invention and applied to a natural nail.
Figure 3:
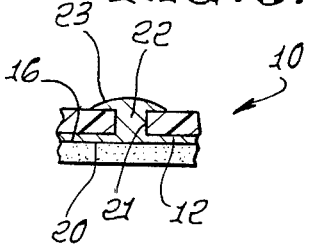
FIG. 3 is an enlarged fragmentary section showing attachment of the FIG. 1 natural and artificial fingernails.
Figure 2:
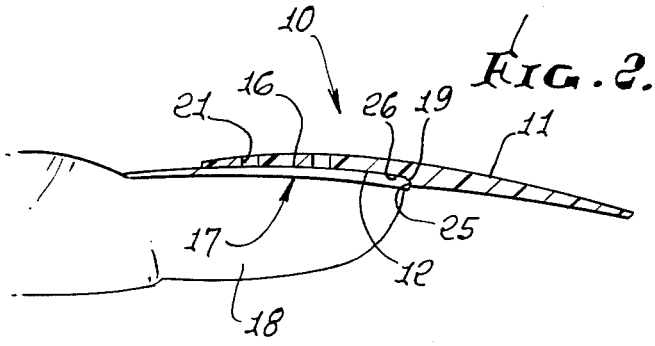
FIG. 2 is a section on lines 2—2 of FIG. 1.

In FIGS. 1–3, the artificial, i.e. molded plastic (acrylic for example) sheet, nail 10 has a convex top side 11, concave underside 12, laterally spaced longitudinally elongated opposite edges 13, a front edge 14, and a rear edge 15. It is sized to fit onto the upper surface 16 of natural nail 17 on finger 18, and project forwardly of the forward edge 19 of nail 17. FIG. 3 shows that the rearward portion of the nail element 10 attaches to the upper surface 16 by means of liquid adhesive extending as a layer 20 between surfaces 12 and 16.

The rearward portion of the nail 10 overlapping natural nail 17 has at least one opening between sides 11 and 12 to receive penetration of liquid adhesive from layer 20 when the artificial nail 10 is pushed down onto the natural nail 17. In the example, four such openings 21 are shown distributed both laterally and longitudinally. FIG. 3 shows the manner in which adhesive penetrates into each opening at 22 and adheres to the walls of the openings when the adhesive cures. In addition, FIG. 3 shows an adhesive cap or head 23 at the upper side of each opening and engaging upper side 11 about the opening. As a result, the adhesive, upon curing, locks to the opening walls and locks the artificial nail to the natural nail, in the manner of a rivet, eliminating undesired "lift-off" of the artificial nail as well as air pockets between the two nails. For best results, the number of holes or openings 21 should be between 1 and 5; and their diameters should be between 0.01 and 0.05 inches in diameter, or cross dimension.

It will be noted that holes 21 are located in the rearward and thinner portion of nail 10 located rearwardly of a crescent shaped step shoulder or distal edge 25 formed by the underside of the nail and forwardly bounding a recess 26 sunk in that underside. The adhesive 22 in openings 21 locks the thinner and more flexible portion of the nail 10 in position. The edge 25 conforms generally to the forward edge 19 of nail 17, and positions that edge.

Figure 4:
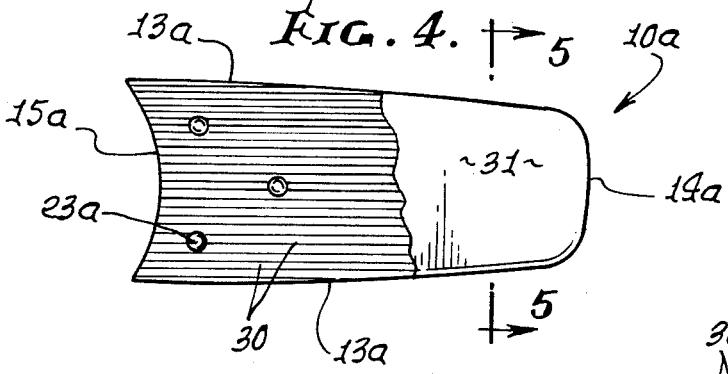
FIG. 4 is a plan view of a modified artificial fingernail.
Figure 5:
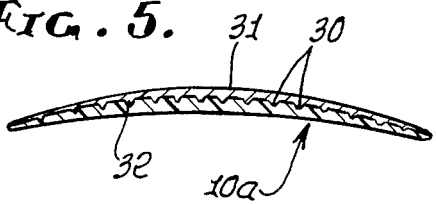
FIG. 5 is a cross-section on lines 5—5 of FIG. 4.

It is a further feature of the invention that the upper side of nail 10 is roughened to better receive and adhere to applied nail polish, as well as to the adhesive cap 23. FIGS. 4 and 5 show such roughness as defined by small grooves 30 extending longitudinally in the top surface of the nail 10*a*, and to the forward edge 14*a*, whereby hardened nail polish or lacquer 31 does not lift off or peel, starting at edge 14. FIG. 5 shows nail polish 31 extending into the grooves 30, as at 32. Numerals employed in both FIGS. 1 and 4 are the same, but bear sub-scripts "a" in FIG. 4.

Figure 6:
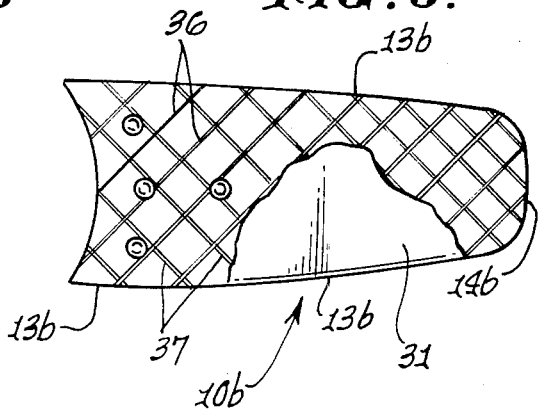
FIG. 6 is a plan view of a further modified nail.

In the artificial nail 10*b* shown in FIG. 6, the grooves in the top surface extend longitudinally and laterally, as for example grooves 36 extending toward one lateral edge, and grooves 37 extending toward the opposite lateral edge 13*b*. Such grooves also intersect the front edge 14*b*, whereby both the front and lateral edges of the nail are intersected by grooves tending to retain nail polish and preventing peel-off, starting at said edges.

For best results, the grooves are barely visible, i.e. smaller than #180 grit size, in cross section.

I claim:

1. In an artificial fingernail attachable to a natural fingernail having a forward edge and a rearward edge, the artificial nail comprising:

(a) a thin plastic sheet element sized to provide a forward extension of the natural nail, (b) the said element having a rearward portion with its underside shaped to fit over and attach to the natural nail by means of liquid adhesive, said element rearward portion also having an upper side, (c) said rearward portion having multiple openings between said under and upper sides to receive liquid adhesive when said underside is pressed downwardly upon the natural nail, whereby the liquid adhesive when cured substantially fills the openings and locks the natural nail to the walls of the openings, said openings being of pin-hole size and extending through said sheet element, said openings having diameters between 0.01 and 0.05 inches, (d) said element forming a recess in said rearward portion to receive and conform generally to the shape of the forward extent of said natural nail, all of said openings intersecting said recess, (e) said element also forming a rearwardly presented crescent shaped distal edge forwardly bounding said recess, all of said openings spaced rearwardly of said distal edge, said element rearwardly of said recess being thinner than said element forwardly of the recess, (f) said upper side having roughening to receive and adhere to nail polish applied to said upper side, said openings communicating with said roughening, (g) said recess opening downwardly throughout the entire length between said rearward edge and said distal edge.

2. The artificial fingernail of claim 1 wherein said roughening includes grooving that extends toward and intersects the forwardmost edge of said artificial fingernail.

3. The artificial fingernail of claim 2 wherein said grooving extends adjacent the forwardmost edge, and the lateral edges of said artificial fingernail.

4. The artificial fingernail of claim 3 wherein said grooving extends toward and intersects said forwardmost edge and said lateral edges of the artificial fingernail.

5. The artificial fingernail of claim 3 wherein said grooving extends over said upper side and between said lateral edges.

6. The artificial fingernail of claim 1 including said adhesive extending in the opening or openings, and also at said under and upper sides, and in cured state, to form an adhesive rivet for attaching the artificial nail to said natural nail.

7. The artificial fingernail of claim 2 wherein the grooving includes multiple grooves having cross sections no larger than about #180 grit size.

* * * * *